US010986430B2

(12) United States Patent
Lee et al.

(10) Patent No.: US 10,986,430 B2
(45) Date of Patent: Apr. 20, 2021

(54) DISPLAY APPARATUS

(71) Applicant: LG Display Co., Ltd., Seoul (KR)

(72) Inventors: Sungtae Lee, Incheon (KR); SeYoung Kim, Seoul (KR); YeongRak Choi, Paju-si (KR); KwangHo Kim, Osan-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 16/862,116

(22) Filed: Apr. 29, 2020

(65) Prior Publication Data

US 2020/0260169 A1 Aug. 13, 2020

Related U.S. Application Data

(63) Continuation of application No. 15/987,244, filed on May 23, 2018, now Pat. No. 10,659,858.

(30) Foreign Application Priority Data

May 31, 2017 (KR) ..... 10-2017-0067999

(51) Int. Cl.
*H04R 1/02* (2006.01)
*H04R 1/28* (2006.01)
(Continued)

(52) U.S. Cl.
CPC ..... *H04R 1/028* (2013.01); *H04R 1/288* (2013.01); *H04R 7/045* (2013.01); *H04R 9/025* (2013.01);
(Continued)

(58) Field of Classification Search
CPC ..... H04R 1/288; H04R 7/045; H04R 9/025; H04R 1/028; H04R 2440/07; H04R 2499/15; H04R 2440/05; H04R 1/02
(Continued)

(56) References Cited

U.S. PATENT DOCUMENTS 6,731,764 B2 * 5/2004 Asada ..... H04R 5/02 381/152
6,826,285 B2 11/2004 Azima
(Continued)

FOREIGN PATENT DOCUMENTS

CN 1930910 A 3/2007
CN 104067638 A 9/2014
(Continued)

OTHER PUBLICATIONS

First Notification of Office Action dated Mar. 2, 2020, issued in corresponding Chinese Patent Application No. 201810493356.1.
(Continued)

*Primary Examiner* — Melur Ramakrishnaiah
(74) *Attorney, Agent, or Firm* — Morgan, Lewis & Bockius LLP

(57) ABSTRACT

Disclosed is a display apparatus that may include a display panel configured to display an image by emitting light, a supporting member disposed on a rear surface of the display panel, a sound generating device disposed between the supporting member and the display panel, and a plurality of partitions at a predetermined interval from the sound generating device, wherein the partitions have different compression force deflections.

22 Claims, 11 Drawing Sheets

(51) Int. Cl.
*H04R 7/04* (2006.01)
*H04R 9/02* (2006.01)

(52) U.S. Cl.
CPC ..... *H04R 2440/05* (2013.01); *H04R 2440/07* (2013.01); *H04R 2499/15* (2013.01)

(58) Field of Classification Search
USPC ..... 381/388, 152, 431
See application file for complete search history.

(56) References Cited

U.S. PATENT DOCUMENTS

| | | | | |
|---|---|---|---|---|
| 9,843,881 | B1 * | 12/2017 | Oates, III | H04R 5/02 |
| 2006/0120542 | A1 | 6/2006 | Lee et al. | |
| 2006/0222199 | A1 * | 10/2006 | Abe | H04R 9/025 381/396 |
| 2007/0064092 | A1 | 3/2007 | Sandberg et al. | |
| 2007/0206822 | A1 | 9/2007 | Whitwell et al. | |
| 2008/0050574 | A1 | 2/2008 | Lovell et al. | |
| 2013/0226337 | A1 * | 8/2013 | Leech | A63B 47/002 700/235 |
| 2014/0241565 | A1 | 8/2014 | Jin | |
| 2017/0280234 | A1 | 9/2017 | Choi et al. | |

FOREIGN PATENT DOCUMENTS

| | | | |
|---|---|---|---|
| CN | 105491474 | A | 4/2016 |
| CN | 106126181 | A | 11/2016 |
| JP | 2004-343362 | A | 12/2004 |
| JP | 2009-100223 | A | 5/2009 |
| KR | 10-1704517 | B1 | 2/2017 |
| WO | 2009/017280 | A1 | 2/2009 |

OTHER PUBLICATIONS

Office Action dated Jan. 25, 2021, issued in corresponding Koren Patent Application No. 10-2017-0067999.

* cited by examiner

DISPLAY APPARATUS

CROSS REFERENCE TO RELATED APPLICATIONS

This application is a Continuation Application of U.S. patent application Ser. No. 15/987,244, filed on May 23, 2018, which claims the benefit of the Korean Patent Application No. 10-2017-0067999 filed on May 31, 2017, both of which are hereby incorporated by reference as if fully set forth herein.

BACKGROUND

Field of the Disclosure

Embodiments of the present disclosure relate to a display apparatus, and more particularly, to a display apparatus capable of generating sound by vibrating a display panel.

Discussion of the Related Art

Recently, as society advances as an information-oriented society, the field of display apparatuses for visually displaying an electrical information signal has rapidly advanced. Consequently, various display apparatuses having excellent performance such as thinness, lightness, and low power consumption are being developed.

Examples of the display apparatuses may include liquid crystal display (LCD) apparatuses, field emission display (FED) apparatuses, an organic light emitting display (OLED) apparatuses, quantum dot light emitting display apparatuses, micro light emitting diode display apparatuses, etc.

Among these display apparatuses, the LCD apparatus may include an array substrate including a thin film transistor, an upper substrate including a color filter and/or black matrix, and a liquid crystal layer interposed between the array substrate and the upper substrate. An alignment state of the liquid crystal layer is controlled based on an electric field applied to two electrodes of a pixel region, whereby light transmittance is adjusted based on the alignment state of the liquid crystal layer, to thereby display an image.

The OLED apparatus, which is a self-light emitting display apparatus, has advantages of low power consumption, fast response speed, high light-emitting efficiency, high luminance and wide viewing angle.

Display apparatuses display an image on a display panel, but a separate speaker may typically be installed for providing sound. In a case where a speaker is installed in a display apparatus, a traveling direction of a sound output through the speaker is typically a direction toward a rear surface of the display panel or a region under the display panel, instead of a front surface of the display panel displaying an image, and thus, the sound does not travel in a direction toward a viewer who is watching an image in front of the display panel. Accordingly, viewer immersion is hindered.

Moreover, a sound output through a speaker travels to a rear surface of a display panel or a region under the display panel, and for this reason, the quality of the sound is degraded due to interference of sound reflected from a wall or a floor.

Moreover, in a case where a speaker included in a set device such as a television (TV) is provided, the speaker occupies a certain space, and due to this, the design and space disposition of the set device are limited.

Therefore, the inventors have recognized the above-described problems and have invented a display apparatus having a new structure, which may output a sound so that a traveling direction of the sound becomes a direction toward a front surface of a display panel, thereby enhancing sound quality.

If a sound generating device is attached to a rear surface of a display panel, vibrations may be mutually overlapped in a specific area of the display panel, whereby it may cause an excessively-high vibration or excessively-low vibration (dip), or there may be no vibration due to a mutual offset of the vibrations in the specific area, which may cause a problem related with inferior sound quality. A display apparatus having a sound generating device with a new structure that may be capable of optimizing an area for forming a sound vibration has been studied.

SUMMARY

Accordingly, the present disclosure is directed to a display apparatus that substantially obviates one or more of the problems due to limitations and disadvantages of related art.

An object of embodiments of the present disclosure is directed to provide a display apparatus capable of outputting sound to a front direction when a sound generating device is attached to a specific area of a display panel, and improving sound quality.

Additional advantages and features of embodiments of the disclosure will be set forth in part in the description which follows and in part will become apparent to those having ordinary skill in the art upon examination of the following or may be learned from practice of embodiments of the disclosure. The objectives and other advantages of embodiments of the disclosure may be realized and attained by the structure particularly pointed out in the written description and claims hereof as well as the appended drawings.

To achieve these and other advantages and in accordance with the purpose of embodiments of the disclosure, as embodied and broadly described herein, there is provided a display apparatus that may include a display panel configured to display an image by emitting light, a supporting member disposed on a rear surface of the display panel, a sound generating device disposed between the supporting member and the display panel, and a plurality of partitions at a predetermined interval from the sound generating device, wherein the partitions have different compression force deflections.

In another aspect of an embodiment of the present disclosure, there is provided a display apparatus that may include a display panel configured to display an image by emitting light, a supporting member disposed on a rear surface of the display panel, a sound generating device disposed between the supporting member and the display panel, and a plurality of partitions provided at a predetermined interval from the sound generating device, wherein the partitions have different densities.

It is to be understood that both the foregoing general description and the following detailed description of embodiments of the present disclosure are exemplary and explanatory and are intended to provide further explanation of the disclosure as claimed.

BRIEF DESCRIPTION OF THE DRAWINGS

The accompanying drawings, which are included to provide a further understanding of embodiments of the disclosure and are incorporated in and constitute a part of this application, illustrate embodiments of the disclosure and together with the description serve to explain the principles of embodiments of the disclosure. In the drawings.

DETAILED DESCRIPTION

Figure 1A:
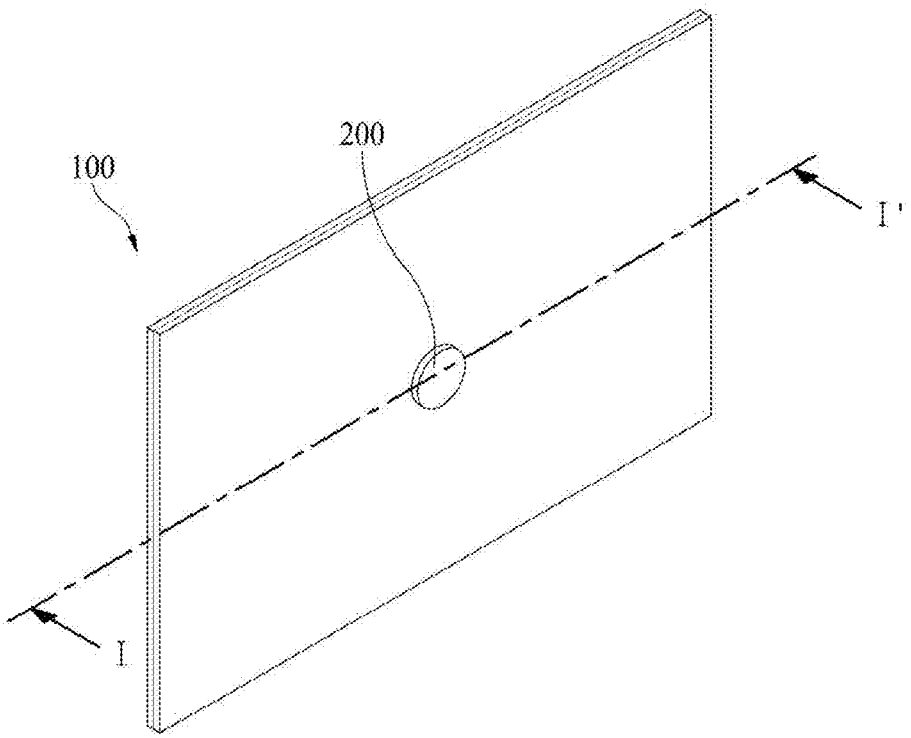
FIG. 1A is a diagram illustrating a display apparatus including a sound generating device according to an example embodiment of the present disclosure.

Reference will now be made in detail to the example embodiments of the present disclosure, examples of which are illustrated in the accompanying drawings. Wherever possible, the same reference numbers will be used throughout the drawings to refer to the same or like parts. Advantages and features of the present disclosure, and implementation methods thereof will be clarified through following embodiments described with reference to the accompanying drawings. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art. Further, the present disclosure is only defined by scopes of claims.

A shape, a size, a ratio, an angle, and a number disclosed in the drawings for describing embodiments of the present disclosure are merely an example, and thus, the present disclosure is not limited to the illustrated details. Like reference numerals refer to like elements throughout. In the following description, when the detailed description of the relevant known function or configuration is determined to unnecessarily obscure the important point of the present disclosure, the detailed description will be omitted. In a case where "comprise", "have", and "include" described in the present specification are used, another part may be added unless "only" is used. The terms of a singular form may include plural forms unless referred to the contrary.

In construing an element, the element is construed as including an error region although there is no explicit description.

In describing a position relationship, for example, when the positional order is described as "on~", "above~", "below~", and "next~", a case which is not contact may be included unless "just" or "direct" is used.

In describing a time relationship, for example, when the temporal order is described as "after~", "subsequent~", "next~", and "before~", a case which is not continuous may be included unless "just" or "direct" is used.

It will be understood that, although the terms "first", "second", etc. may be used herein to describe various elements, these elements should not be limited by these terms. These terms are only used to distinguish one element from another. For example, a first element could be termed a second element, and, similarly, a second element could be termed a first element, without departing from the scope of the present disclosure.

In describing elements of the present disclosure, the terms "first", "second", "A", "B", "(a)", and "(b)" may be used. The terms are merely for differentiating one element from another element, and the essence, sequence, order, or number of a corresponding element should not be limited by the terms. It will be understood that when an element or layer is described as being "connected", "coupled", or "adhered" to another element or layer, the element or layer can be directly connected or adhered to the other element or layer, but the other element or layer can be "disposed" between elements or layers, or elements or layers can be "connected", "coupled", or "adhered" to each other through the other element or layer.

In the present disclosure, examples of a display apparatus may include a narrow-sense display apparatus such as an organic light emitting display (OLED) module, a liquid crystal display module (LCM), or a quantum dot display (QD) module, a display panel and a driving unit for driving the display panel. Also, examples of the display apparatus may include a set device (or a set apparatus) or a set electronic apparatus such as a notebook computer, a TV, a computer monitor, an automotive display or another type of equipment display including for vehicles, or a mobile electronic apparatus such as a smartphone or an electronic pad, which is a complete product (or a final product) including an LCM, an OLED module, or a QD module.

Therefore, in the present disclosure, examples of the display apparatus may include a narrow-sense display apparatus itself, such as an LCM, an OLED module, or a QD module, and a set apparatus which is a final consumer apparatus or an application product including the LCM, the OLED module, or the QD module.

Moreover, depending on the case, the LCM, the OLED module, or the QD module including a display panel and a driving unit may be referred to as "display apparatus" in a narrow-sense, and the electronic apparatus as a final product including the LCM, the OLED module, or the QD module may be differently referred to as "set apparatus" or "set device". For example, the display apparatus in a narrow-sense may include a display panel, such as an LCM, an OLED module, or a QD module, and a source printed circuit board (PCB) which is a controller for driving the display panel. The set device may further include a set PCB which is a set controller electrically connected to the source PCB to overall control the set device.

The display panel used for the example embodiments of the present disclosure may be any type of display panel, for example, a liquid crystal display panel, an organic light emitting diode (OLED) display panel, a quantum dot display panel, an electroluminescent display panel, etc., but is not limited to these types. For example, the display panel of the present disclosure may be any panel capable of generating sound in accordance with a vibration by a sound generating device. And the display panel used for the embodiment of the present disclosure is not limited in its shape or size.

In more detail, if the display panel is the liquid crystal display panel, the display panel may include a plurality of gate lines, a plurality of data lines, and a plurality of pixels respectively provided in a plurality of pixel areas defined by intersections of the gate lines and the data lines. Also, the display panel may include an array substrate including a thin film transistor (TFT), which is a switching element for adjusting a light transmittance of each of the plurality of pixels, an upper substrate including a color filter and/or a black matrix, and a liquid crystal layer between the array substrate and the upper substrate.

Moreover, if the display panel is the organic light emitting display panel, the display panel may include a plurality of gate lines, a plurality of data lines, and a plurality of pixels respectively provided in a plurality of pixel areas defined by intersections of the gate lines and the data lines. Also, the display panel may include an array substrate including a TFT which is an element for selectively applying a voltage to each of the pixels, an organic light emitting device layer on the array substrate, and an encapsulation substrate disposed on the array substrate to cover the organic light emitting device layer. The encapsulation substrate may protect the TFT and the organic light emitting device layer from an external impact and may prevent water or oxygen from penetrating into the organic light emitting device layer. Also, a layer provided on the array substrate may include an inorganic light emitting layer (for example, a nano-sized material layer, a quantum dot, or the like). As another example, the display panel may include a micro light emitting diode.

Moreover, the display panel may further include a backing such as a metal plate attached on the display panel. However, the present embodiments are not limited to the metal plate, and the display panel may include another structure.

In the present disclosure, the display panel may be applied to vehicles as a user interface module such as a central control panel for automobiles. For example, the display panel may be provided between occupants sitting on two front seats in order for a vibration of the display panel to be transferred to the inside of a vehicle. Therefore, an audio experience in a vehicle is improved in comparison with a case where speakers are disposed on interior sides of the vehicle.

Features of various embodiments of the present disclosure may be partially or overall coupled to or combined with each other, and may be variously inter-operated with each other and driven technically as those skilled in the art can sufficiently understand. The embodiments of the present disclosure may be carried out independently from each other, or may be carried out together in co-dependent relationship.

Hereinafter, embodiments of the present disclosure will be described in detail with reference to the accompanying drawings.

FIG. 1A is a diagram illustrating a display apparatus including a sound generating device according to an example embodiment of the present disclosure.

With reference to FIG. 1A, the display apparatus includes a display panel 100 configured to display an image, and a sound generating device 200 for generating sound by vibrating the display panel 100. The sound generating device 200 may be referred to as an actuator, exciter, or transducer.

Figure 1B:
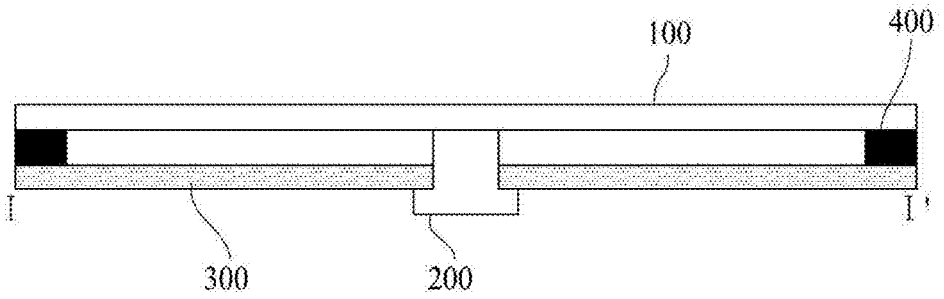
FIG. 1B is a cross-sectional view taken along I-I' of FIG. 1A.

FIG. 1B is a cross-sectional view taken along I-I' of FIG. 1A. With reference to FIG. 1B, the display apparatus may include the sound generating device 200, and a supporting member 300.

The supporting member 300 may support at least one of rear and side (lateral) surfaces of the display panel 100. And, the sound generating device 200 may be fixed to the supporting member 300. Also, a thin film of a metal material with good thermal conductivity is additionally disposed between the rear surface of the display panel 100 and the sound generating device 200 so that it may be possible to prevent local areas of the display panel 100 from being influenced by heat generated in the sound generating device 200.

In this specification, for example, the support member 300 may be a cover bottom. In addition, the supporting member 300 may include a middle cabinet provided to surround a lateral surface of the display panel 100, connected with the cover bottom, and provided to accommodate one edge of the display panel 100 so as to support the display panel 100. The supporting member 300 may include the cover bottom, or may include the cover bottom and the middle cabinet, but is not limited thereto. The supporting member 300 may include any structure capable of supporting the rear surface or lateral surface of the display panel 100. And, the supporting member 300 may be a plate-shaped member formed over a rear surface or entire surface of the display panel 100.

The supporting member 300 may be referred to as a cover bottom, a plate bottom, a back cover, a base frame, a metal frame, a metal chassis, a chassis base, or an m-chassis. Thus, the supporting member 300 may be embodied in all types of frame or plate-shape structures which are used as a supporter for supporting the display panel 100, and are disposed at the rear of the display apparatus. The supporting member 300 may be formed of one of metal, glass and plastic materials, or at least two among metal, glass and plastic materials, wherein the metal material may be aluminum (Al), but is not limited thereto.

A partition may be provided between the supporting member 300 and the display panel 100. The partition corresponds to an air gap or space for generating sound when the display panel 100 is vibrated by the sound generating device 200. The partition may be the space or air gap for generating sound or transferring sound. The partition may be an enclosure or baffle, but is not limited thereto. The partition may be additionally prepared at four outer sides of the display panel 100. The partition may be formed in a sealed structure or unsealed structure. Also, an adhesion member 400 is disposed in the edge of the supporting member 300 and the display panel 100. The adhesion member 400 adheres the display panel 100 and the supporting member 300 to each other, wherein the adhesion member 400 may be a double-sided tape, but is not limited thereto.

Accordingly, the display apparatus according to example embodiments of the present disclosure includes the sound generating device for generating sound by vibrating the display panel so that it may be possible to generate sound output advancing to the front of the display panel, to thereby improve a user's immersion.

Furthermore, the display apparatus according to example embodiments of the present disclosure includes the sound generating device capable of generating sound by vibrating the display panel. Thus, there may be no need for the speaker, which enables improvements in the degree of freedom of design of the set apparatus and arrangement of the speaker.

Figure 2A:
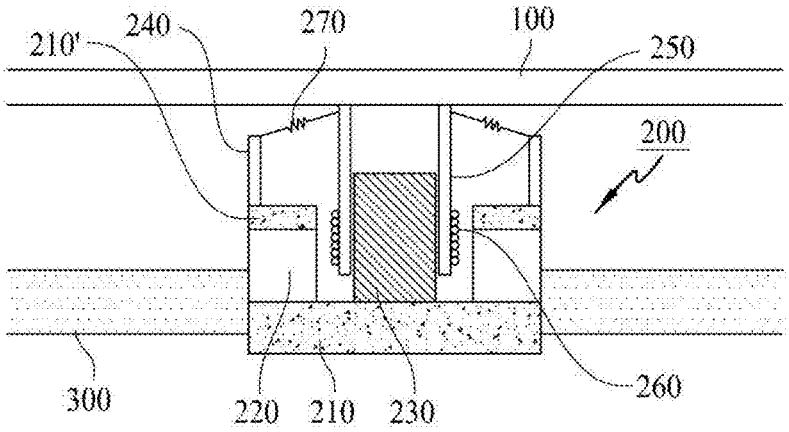
FIGS. 2A and 2B are cross-sectional views of a sound generation device according to an example embodiment of the present disclosure.
Figure 2B:
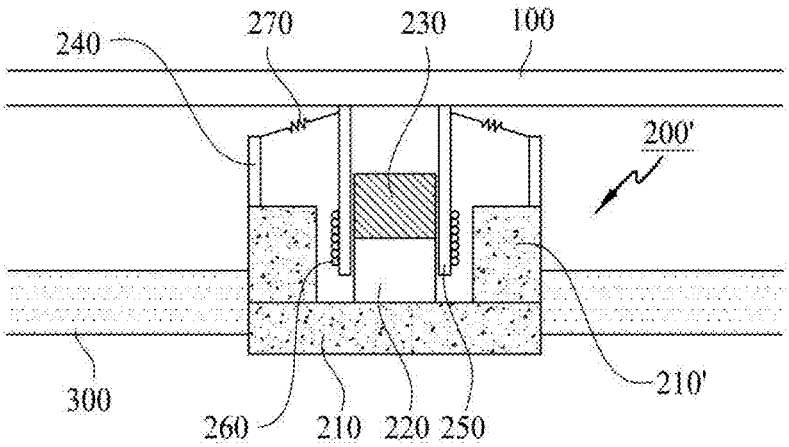

FIGS. 2A and 2B are cross-sectional views of a sound generation device according to an example embodiment of the present disclosure.

The sound generating device may be categorized into a first structure corresponding to an external magnetic type where a magnet is disposed at an external side of a coil, and a second structure corresponding to an internal magnetic type where a magnet is disposed at an internal side of a coil. The first structure may be expressed as a dynamic type or external magnetic type, and the second structure may be expressed as a micro type or internal magnetic type. FIG. 2A illustrates the first structure, and FIG. 2B illustrates the second structure.

With reference to FIG. 2A, the sound generating device 200 may include plates 210 and 210', a magnet 220 on the plate 210, a center pole 230 on the plate 210, a bobbin 250 disposed around the center pole 230, and a coil 260 wound on an outer surface of the bobbin 250.

In detail, the magnet 220 is disposed on the first plate 210, and the second plate 210' is disposed on the magnet 220. The first plate 210 and the second plate 210' support the magnet 220, and fix the sound generating device 200 to the supporting member 300. Accordingly, the first plate 210 may be fixed to a supporting hole formed in the supporting member 300, and the magnet 220 may be fixedly supported between the first plate 210 and the second plate 210'.

At least one of the first plate 210 and the second plate 210' may be formed of a magnetic material such as iron (Fe). The first plate 210 and the second plate 210' are not limited to these terms, and they may be referred to as yokes.

The magnet 220 may use a sintered magnet of barium ferrite, and the magnet 220 may be formed of ferric oxide ($Fe_2O_3$), barium carbonate ($BaCO_3$), neodymium (Nd) magnet, strontium ferrite with improved magnetic component, aluminum (Al), nickel (Ni), or alloy-casting magnet of cobalt (Co), but is not limited to these materials. For example, the neodymium magnet may be neodymium-iron-boron (Nd—Fe—B).

A frame 240 is disposed on the second plate 210' along the periphery of the first plate 210. The center pole 230 is disposed on the center of the first plate 210. The center pole 230 and the first plate 210 may be formed as one body. The center pole 230 may be referred to as pole pieces. And, pole pieces may be additionally provided on the center pole 230.

The bobbin 250 is disposed to surround the center pole 230. The coil 260 is wound on a lower outer area, for example, a lower outer surface of the bobbin 250, and a current or a voice signal for generating sound is applied to the coil 260.

The bobbin 250 may be implemented as a ring-shaped structure which is formed of paper or an aluminum sheet, and the coil 260 may be wound around a certain lower side of the bobbin 250. The generic term for the bobbin 250 and the coil 260 may be a voice coil.

Moreover, a damper 270 may be disposed between the frame 240 and a portion of an upper side of the bobbin 250. The damper may be expressed by using another term such as an edge.

FIG. 2B illustrates the second structure where a magnet is disposed at an internal side of a coil. With reference to FIG. 2B, a sound generation device 200' having the second structure may include a magnet 220 disposed on a first plate 210, a center pole 230 disposed on the magnet 220, a bobbin 250 disposed near the magnet 220 and the center pole 230, and a coil 260 wound around the bobbin 250.

In detail, the first plate 210 may be fixed to a supporting hole provided in a supporting member 300. The magnet 220 may be disposed on the first plate 210, and the center pole 230 may be disposed on the magnet 220. Also, the center pole 230 may be referred to as pole pieces. Alternatively, pole pieces may be further disposed on the center pole 230.

The bobbin 250 may be disposed to surround the magnet 220 and the center pole 230, and the coil 260 is wound on the outer surface of the bobbin 250.

A second plate 210' is disposed on the periphery of the first plate 210, and a frame 240 is disposed outside the periphery of the second plate 210'. And, a damper 270 is disposed between the frame 240 and the bobbin 250.

In the sound generation device having the second structure, leakage magnetic flux is relatively small, and a total size is relatively small, in comparison with the first structure where a magnet is disposed outside a coil.

The sound generation device used for the display apparatus according to an example embodiment of the present disclosure is not limited to the first structure illustrated in FIG. 2A and the second structure illustrated in FIG. 2B. In other example embodiments, the display apparatus may include another kind of sound generation device which vibrates a display panel to generate a sound.

Figure 3A:
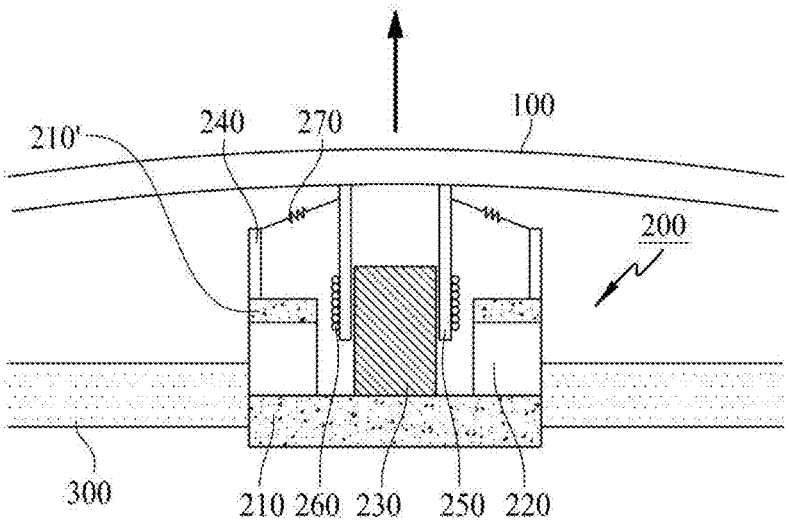
FIGS. 3A and 3B are diagrams for describing a sound generating operation performed by a sound generation device having a first structure according to an example embodiment of the present disclosure.
Figure 3B:
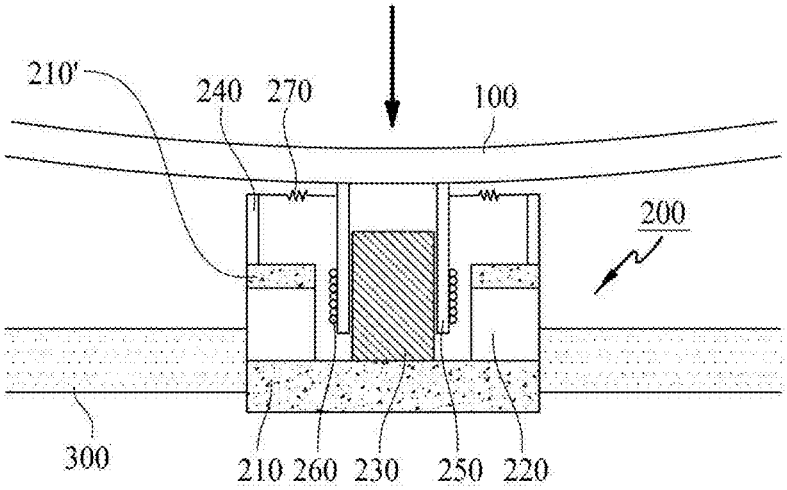

FIGS. 3A and 3B are diagrams for describing a sound generating operation performed by a sound generation device having a first structure according to an example embodiment of the present disclosure.

FIG. 3A illustrates a state where a current is applied. With reference to FIG. 3A, the center pole 230 connected with a lower surface of the magnet 220 becomes the N pole, and the first plate 210 connected with an upper surface of the magnet 220 becomes the S pole, whereby an external magnetic field is generated between the coil 260. In this state, if the current for generating sound is applied to the coil 260, an applied magnetic field is formed around the coil 260, whereby a force for upwardly moving the bobbin 250 is generated by the applied magnetic field and the external magnetic field. In detail, if the current is applied to the coil 260, the magnetic field is generated around the coil 260, and the external magnetic field is generated by the magnet 220, whereby the entire bobbin 250 is guided and moved upward by the center pole 230 based on Fleming's law.

As one surface of the bobbin 250 is in contact with the rear surface of the display panel 100, the display panel 100 is vibrated in an upper direction (indicated by an arrow) according to whether or not the current is applied to the coil 260, and sound wave (or sound) is generated by the vibration of the display panel 100.

In this state, if the current is stopped or a current is applied in the opposite direction, as shown in FIG. 3B, a force of downwardly moving the bobbin 250 is generated based on the principles illustrated in FIG. 3A, whereby the display panel 100 is vibrated in a lower direction (indicated by an arrow).

The damper 270 is disposed between the frame 240 and the upper portion of the bobbin 250. The damper 270 is formed in a wrinkled structure having elasticity, whereby the damper 270 controls the up-and-down vibration of the bobbin 250 by contraction and relaxation movements in accordance with the up-and-down movement of the bobbin 250. That is, the damper 270 is connected with the bobbin 250 and the frame 240, whereby the up-and-down vibration of the bobbin 250 may be controlled by a restoring force of the damper 270. In detail, if the bobbin 250 vibrates to be higher or lower than a predetermined height, the bobbin 250 may be restored to its original position by the restoring force of the damper 270.

According to the direction and level of the current applied to the coil 260, the display panel 100 may be vibrated in the up-and-down direction so that it may be possible to generate the sound wave by the vibration.

Figure 4A:
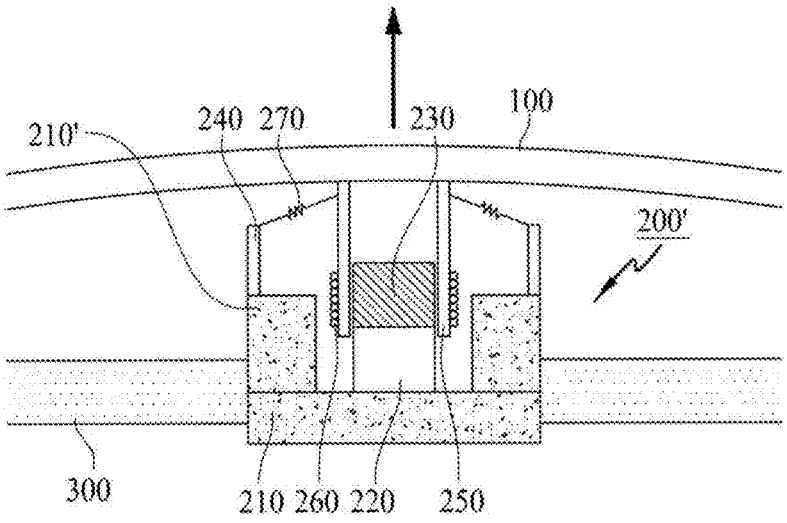
FIGS. 4A and 4B are diagrams for describing a sound generating operation performed by a sound generation device having a second structure according to an example embodiment of the present disclosure.
Figure 4B:
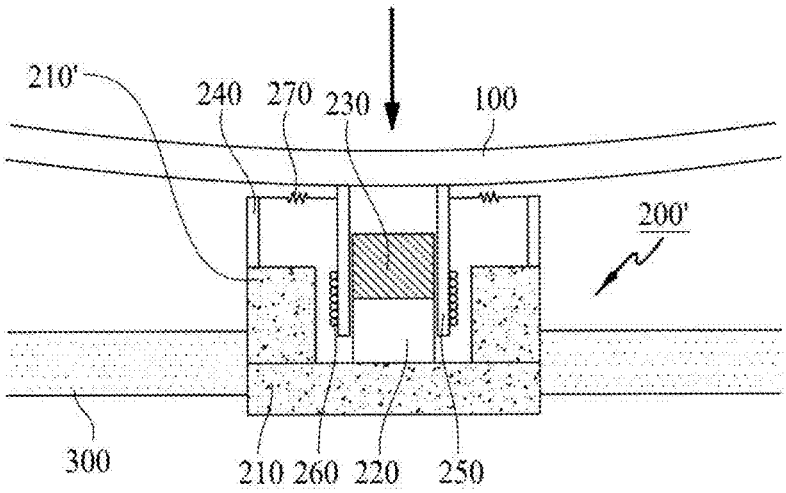

FIGS. 4A and 4B are diagrams for describing a sound generating operation performed by a sound generation device having a second structure according to an example embodiment of the present disclosure.

FIG. 4A illustrates a state where a current is applied. With reference to FIG. 4A, the second plate 210' becomes the S pole, and the center pole 230 connected with an upper surface of the magnet 220 becomes the N pole, whereby an external magnetic field is generated between the coil 260. These may be opposite polarities to those described above. It may be possible to realize the same operation by changing a winding direction of the coil 260. In this case, if the current for generating sound is applied to the coil 260, an applied magnetic field is formed around the coil 260, whereby a force for upwardly moving the bobbin 250 is generated by the applied magnetic field and the external magnetic field. In detail, if the current is applied to the coil 260, the magnetic field is generated around the coil 260, and the external magnetic field is generated by the magnet 220, whereby the entire bobbin 250 is guided and moved upward by the center pole 230 based on Fleming's law.

As one surface of the bobbin 250 is in contact with the rear surface of the display panel 100, the display panel 100 is vibrated in an upper direction (indicated by an arrow) according to whether or not the current is applied to the coil 260, and a sound wave (or sound) is generated by the vibration of the display panel 100.

In this state, if the current is stopped or a current is applied in the opposite direction, as shown in FIG. 4B, a force of downwardly moving the bobbin 250 is generated based on the principles illustrated in FIG. 4A, whereby the display panel 100 is vibrated in a lower direction (indicated by an arrow).

The damper 270 is disposed between the frame 240 and some portion of the upper portion of the bobbin 250. The damper 270 is formed in a wrinkled structure having elasticity, whereby the damper 270 controls the up-and-down vibration of the bobbin 250 by contraction and relaxation movements in accordance with the up-and-down movement of the bobbin 250. That is, the damper 270 is connected with the bobbin 250 and the frame 240, whereby the up-and-down vibration of the bobbin 250 may be controlled by a restoring force of the damper 270. In detail, if the bobbin 250 vibrates to be higher or lower than a predetermined height, the bobbin 250 may be restored to its original position by the restoring force of the damper 270.

Accordingly, the display panel 100 may be vibrated in the up-and-down direction in accordance with the direction and level of the current applied to the coil 260, to thereby generate the sound wave by the vibration.

Figure 5A:
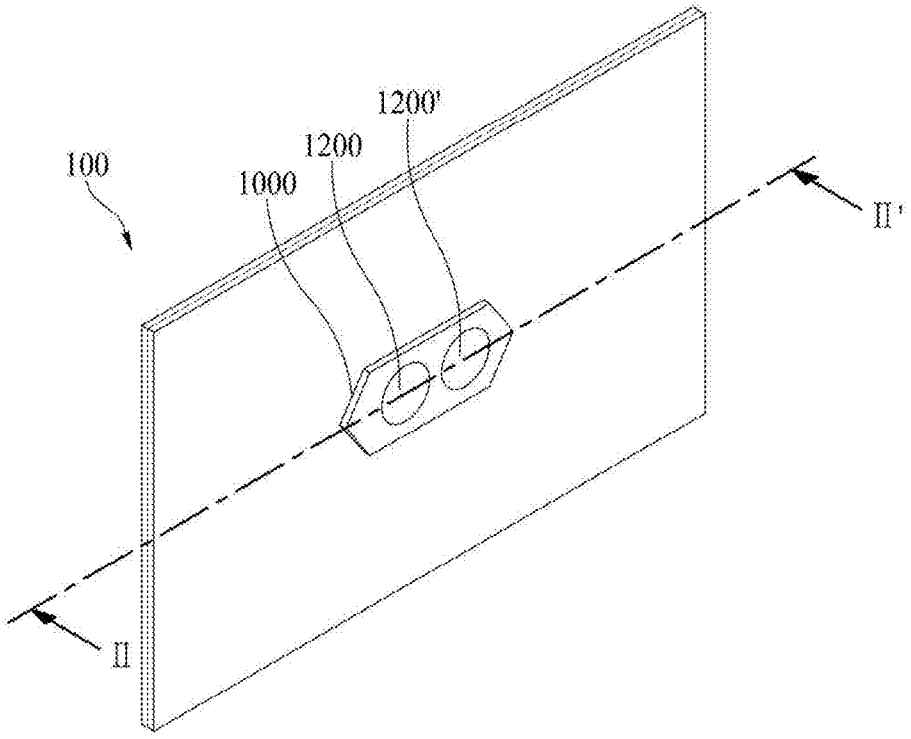
FIG. 5A is a diagram illustrating another example embodiment of a sound generation device of the present disclosure.
Figure 5B:
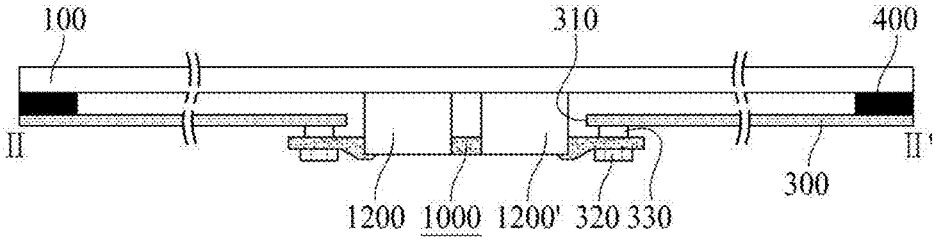
FIG. 5B is a cross-sectional view taken along II-IP of FIG. 5A.

FIGS. 5A and 5B illustrate another example embodiment of a sound generation device of the present disclosure. FIG. 5A is a perspective view illustrating a sound generating device according to another example embodiment of the present disclosure, and FIG. 5B is a cross-sectional view taken along II-IP of FIG. 5A.

With reference to FIG. 5A, a display apparatus may include a display panel 100 configured to display an image, and first and second sound generating devices 1200 and 1200' for generating sound by vibrating the display panel 100.

The first sound generation device 1200 and the second sound generation device 1200' may be disposed adjacent to each other. In a case where a plurality of sound generation devices are provided and spaced apart from one another, it may be difficult to uniformly maintain a contact characteristic between the sound generation devices and a display panel, and sound quality may be degraded due to interference and delay between the plurality of sound generation devices. Therefore, in an example embodiment of the present disclosure where sound generation devices are disposed adjacent to each other, interference or delay between sound waves generated by the sound generation devices may be reduced in comparison with a case where a plurality of sound generation devices are provided and spaced apart from one another, and thus, a sound output characteristic is enhanced. This will be described in detail with reference to FIG. 7.

The first structure or the second described above with reference to FIG. 2A or 2B may be applied to a structure of each of the first sound generation device 1200 and the second sound generation device 1200'. Moreover, a fixing device 1000 for fixing the first sound generation device 1200 and the second sound generation device 1200' may be provided. The fixing device 1000 may include a mold structure which may be formed of a material, such as plastic and/or the like, through a molding process, but is not limited thereto. The fixing device 1000 will be described below with reference to FIG. 6.

With reference to FIG. 5B, the display apparatus may include the first sound generating device 1200, the second sound generating device 1200', and a supporting member 300. The supporting member 300 may support one or more of a rear surface and a side (lateral) surface of a display panel 100. Also, the supporting member 300 may be a plate member which includes a metal or plastic material and is provided on a rear surface of the display panel 100 or all over the display panel 100.

Moreover, a nut 330 fixed to the supporting member 300 may be further provided, and the fixing device 1000 may be fixed to the nut 330 by a screw 320 inserted into an insertion hole of the fixing device 1000. Therefore, a screw-through hole may be provided in an inner surface of the nut 330, and thus, after a mounting hole of the fixing device 1000 is aligned with the screw-through hole of the nut 330, the fixing device 1000 may be fixed to the supporting member 300 by fastening the screw 320.

The nut 330 may be, for example, a self-clinching nut. Examples of the self-clinching nut may include a PEM® nut. If the self-clinching nut is used, some of a vibration generated by each of the first sound generation device 1200 and the second sound generation device 1200' may be absorbed by the nut, and thus, a vibration transferred to the supporting member 300 is reduced.

Moreover, in the display device according to examples of the present embodiment, the supporting member and the sound generation device may be fixed by the nut and the screw included in the supporting member, and thus, a thickness of the display panel is reduced.

Moreover, an adhesive member 400 may be disposed in an edge of each of the display panel 100 and the supporting member 300 and may attach the display panel 100 on the supporting member 300. The adhesive member 400 may include a double-sided tape, a single-sided tape, an adhesive, a bond, and/or the like, but is not limited thereto.

Figure 6:
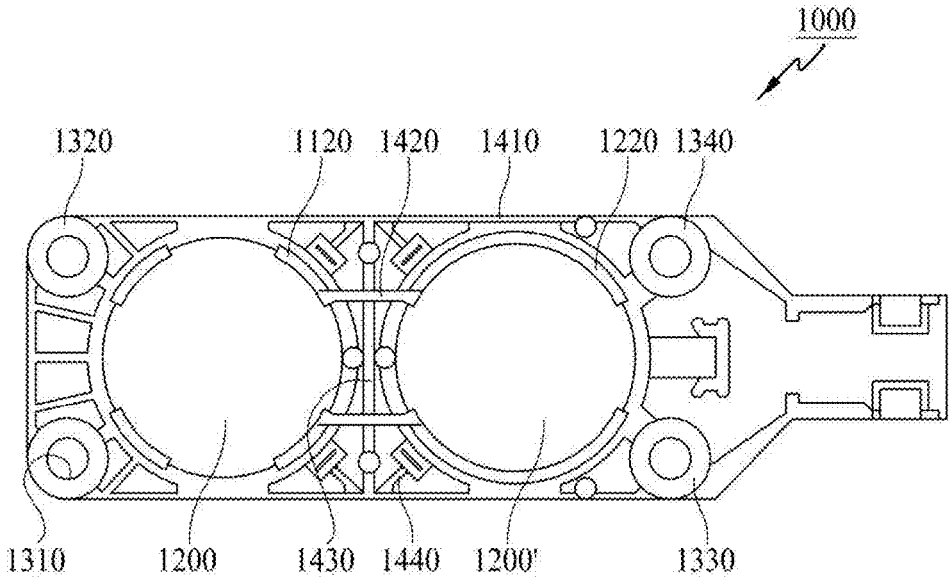
FIG. 6 is a diagram illustrating a fixing device according to another example embodiment of a sound generation device of the present disclosure.

FIG. 6 is a diagram illustrating a fixing device according to another example embodiment of a sound generation device of the present disclosure. With reference to FIG. 6, the fixing device 1000 of the sound generating device may be an integrated type fixing device for supporting and fixing the first sound generating device 1200 and the second sound generating device 1200' being adjacent to each other. The fixing device 1000 of the sound generating device may include a supporting portion for supporting the sound generating device 1200 and 1200', a plurality of rib portions disposed in the periphery of the sound generating device 1200 and 1200', and a plurality of holes for fixing the fixing device 1000 and the supporting member 300 to each other.

In detail, the supporting portion may include a first supporting portion 1120 for supporting the first sound generating device 1200, and a second supporting portion 1220 for supporting the second sound generating device 1200'. The first supporting portion 1120 supports predetermined portions of lateral and rear surfaces of the first sound generating device 1200, wherein the first supporting portion 1120 may have a cylinder shape. The second supporting portion 1220 supports predetermined portions of lateral and rear surfaces of the second sound generating device 1200', wherein the second supporting portion 1220 may have a cylinder shape.

Moreover, each of the first supporting part 1120 and the second supporting part 1220 may further include two or four arc-shaped protrusions. One surface of each of the protrusions may be bent to an inner side of each of the first and second sound generation devices 1200 and 1200' and may support a portion of a rear surface of each of the first and second sound generation devices 1200 and 1200', thereby preventing the first and second sound generation devices 1200 and 1200' from deviating to the outside of the fixing device 1000 of the sound generation device.

Moreover, a plurality of rib parts may be disposed near the first supporting part 1120 and the second supporting part 1220, for maintaining a rigidity of the fixing device 1000 of the sound generation device and preventing the fixing device 1000 of the sound generation device from being deformed even when being used for a long-time use.

In more detail, the plurality of rib portions may include the first rib portion 1410 which extends from the outer surface of the first supporting portion 1120 and the second supporting portion 1220 in a horizontal direction, the second rib portion 1420 for connecting the first supporting portion 1120 and the second supporting portion 1220 with each other in the horizontal direction, and the third rib portion 1430 connected with the first rib portion 1410 in a vertical direction. Herein, the horizontal direction is a direction of a long side along which the two sound generating devices are disposed, and the vertical direction is a direction which is perpendicular to the horizontal direction.

The first rib portion 1410 extends from the outer surface of the first supporting portion 1120 and the second supporting portion 1220 in a longitudinal direction, to thereby form a horizontal-direction external structure of the fixing device 1000 of the sound generating device.

A central area of the first rib portion 1410, that is, a central area between the first supporting portion 1120 and the second supporting portion 1220 may be relatively higher or thicker than each of both side areas of the first rib portion 1410. Accordingly, even though the two sound generating devices are vibrated for a long time period, it may be possible to prevent the fixing device 1000 of the sound generating device from being deformed, and to reduce a change of a relational position between the display panel and the two sound generating devices. Moreover, one or more second rib parts 1420 where the first supporting part 1120 and the second supporting part 1220 are connected to each other as one body may be disposed inside the first rib part 1410.

In FIG. 6, two second rib parts 1420 are illustrated as being provided, but are not limited thereto. In other embodiments, the second rib part 1420 may be provided as one or three or more. Moreover, one or more third rib parts 1430 which are connected to the first and second rib parts 1410 and 1420 as one body and extend in the horizontal direction may be provided between two second rib parts 1420 or between two first rib parts 1410.

In FIG. 6, a structure where one third rib part 1430 is provided and long extends between two first rib parts 1410 is illustrated. However, the present example embodiments are not limited thereto, and the third rib part 1430 may shortly extend between two second rib parts 1420.

Moreover, one or more fourth rib parts 1440 which obliquely extend between the first supporting part 1120 or the second supporting part 1220 and the first rib part 1410 may be further provided. The fourth rib part 1440 prevents the bending deformation of the fixing device 1000 of the sound generation device by heat generated from long-time driving of the sound generation device.

Therefore, since the display apparatus according to the example embodiment includes the fixing device fixing the pair of sound generation devices and the plurality of rib parts near the sound generation devices, the rigidity of the sound generation devices may be maintained, and a sound characteristic change caused by a long-time operation may be reduced.

Moreover, a separation distance between the first supporting part 1120 and the second supporting part 1220 may be greater than a minimum threshold value which enables a rib part to be formed, and may be less than a maximum threshold value which is a diameter of each of the first sound generation device 1200 and the second sound generation device 1200'. If the separation distance between the first supporting part 1120 and the second supporting part 1220 is equal to or greater than the minimum threshold value, the degradation in sound quality may be reduced. Therefore, the separation distance between the first supporting part 1120 and the second supporting part 1220 may be adjusted less than the diameter of each of the first sound generation device 1200 and the second sound generation device 1200', and thus, the degradation in sound quality is reduced. For example, if a size (or a diameter) of the sound generation device is D, the separation distance should be less than the size D of the sound generation device and greater than about 7 mm, which may be the minimum threshold value. The change in sound quality characteristic may not be greater in a case where the size D of the sound generation device is about 28 mm, than in a case where the size D of the sound generation device is about 0.85D (about 23.6 mm).

Moreover, a plurality of mounting holes for fixing the fixing device 1000 to the supporting member 300 may be provided. Because the hole is provided in the inner surface of the nut 330 illustrated in FIG. 5B, a plurality of mounting holes 1310, 1320, 1330, and 1340 of the fixing device 1000 may be aligned with the hole of the nut 330, and then, by fastening the screw 320, the fixing device 1000 may be fixed to the supporting member 300.

Moreover, according to another example embodiment of the present disclosure, if a pair of sound generation devices is applied, a uniform sound pressure is generated in a whole frequency band, and thus, a good sound output characteristic is realized.

Figure 7:
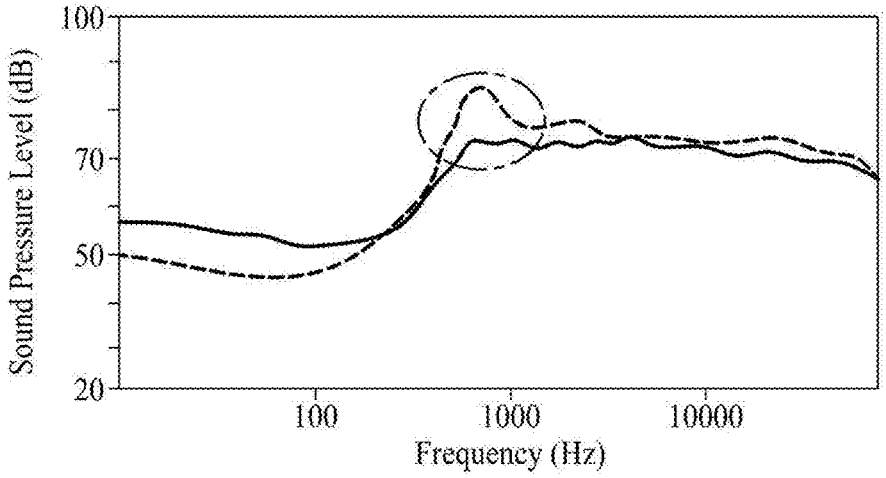
FIG. 7 is a diagram illustrating the sound output characteristics according to another example embodiment of a sound generation device of the present disclosure.

FIG. 7 is a diagram illustrating the sound output characteristics according to another embodiment of a sound generation device of the present disclosure. In FIG. 7, a dotted line indicates a case where the two sound generating devices are provided at a predetermined interval from each other, and are fixed separately. In this case, a dip phenomenon (indicated by a circle) may occur by a sudden raise of sound pressure in 800~900 Hz range.

Due to the dip phenomenon, a strong sound pressure may be generated in a specific frequency by interference or delay of the sound wave generated in the two sound generating devices which are provided at a predetermined interval from each other and are fixed separately, which might cause deterioration of sound quality.

And, in FIG. 7, a solid line indicates a case where the fixing device 1000 of the sound generating device integrally is used to fix the two sound generating devices to each other as an example embodiment of the present disclosure. In comparison to the dotted line of FIG. 7, the solid line of FIG. 7 shows that the dip phenomenon caused by the abnormally-increased sound pressure in the specific frequency may be removed significantly.

Therefore, if applying the fixing device 1000 of the sound generating device according to another example embodiment of the present disclosure, it may be possible to maintain uniform sound pressure in the entire frequency range, to thereby improve the sound output characteristics.

Figure 8:
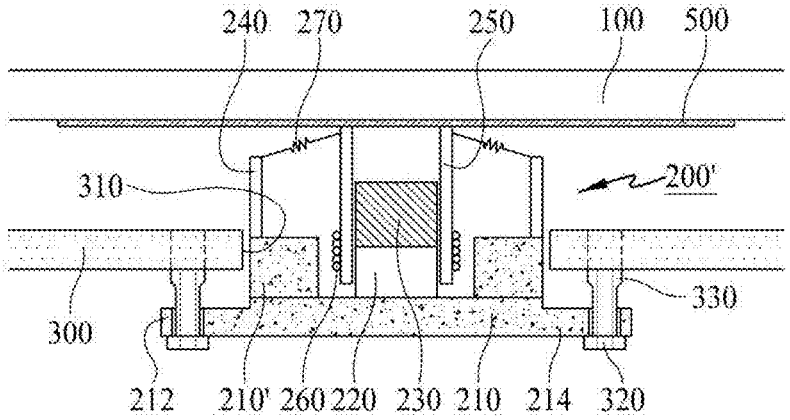
FIG. 8 is a diagram illustrating a coupling structure of a supporting member and a sound generation device according to an example embodiment of the present disclosure.

FIG. 8 is a diagram illustrating a coupling structure of a supporting member and a sound generation device according to an example embodiment of the present disclosure. In an example embodiment of the present disclosure, all of a sound generation device having the first structure and a sound generation device having the second structure may be applied. Hereinafter, the second structure of the sound generating device will be described for example.

With reference to FIG. 8, the sound generating device 200' may include a diameter expanding portion 214, and the diameter expanding portion 214 is formed as one body with the first plate 210 of the sound generating device 200'. The first plate 210 of the sound generating device 200' is not a cylinder shape. Herein, one portion of the first plate 210 has a protrusion portion which is larger than a diameter of the remaining area of the first plate 210. The protrusion portion with a relatively large diameter may be referred to as the diameter expanding portion 214. The diameter expanding portion 214 has a ring shape, and an extension portion 212 for fixation of the sound generating device 200' is formed in a predetermined portion of the diameter expanding portion 214.

A screw 320 and a nut 330 may be provided in the extension part 212. The sound generation device 200' may be coupled to a supporting member 300 by the screw 320 by using the nut 330 fixed to the supporting member 300. The nut 330 may be, for example, a self-clinching nut. Examples of the self-clinching nut may include a PEM® nut.

If the self-clinching nut is used, some of a vibration generated by the sound generation device 200' may be absorbed by the self-clinching nut, and thus, a vibration transferred to the supporting member 300 may be reduced. Also, the sound generation device 200' may be accommodated into a supporting hole 310 included in the supporting member 300.

A thermal diffusion plate 500 may be disposed between the sound generating device 200' and the display panel 100. The thermal diffusion plate 500 may be formed of a material with good thermal conductivity to prevent the display panel from being influenced by heat generated in accordance with the vibration of the sound generating device 200'. For example, the thermal diffusion plate 500 may be formed of a metal material such as aluminum (Al) or copper (Cu), but is not limited thereto. The thermal diffusion plate 500 may be referred to as a heat-dissipation member.

Figure 9A:
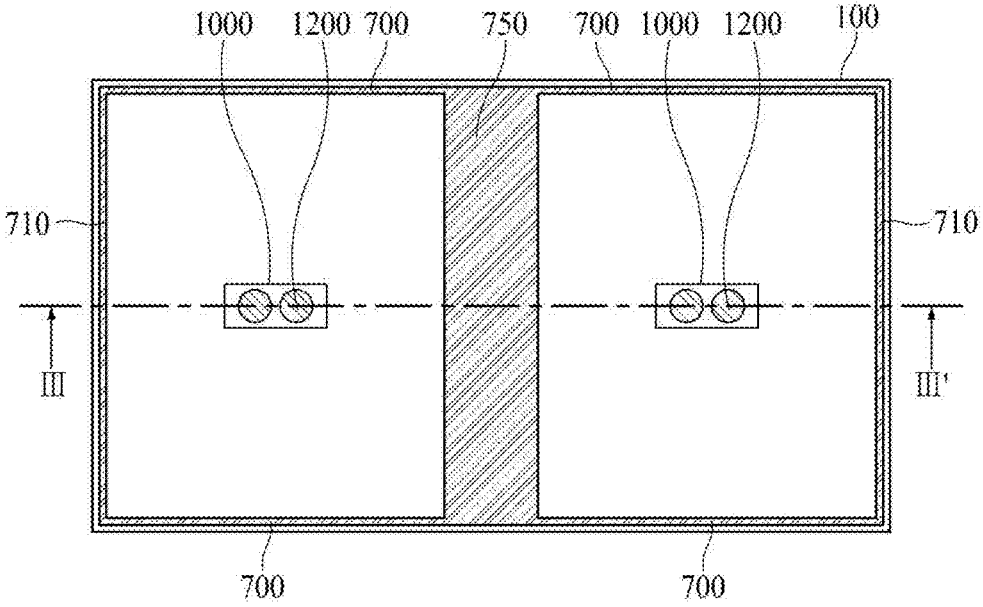
FIG. 9A is a diagram for describing a structure of connecting the sound generating device and partition with a rear surface of a display panel according to an example embodiment of the present disclosure.
Figure 9B:
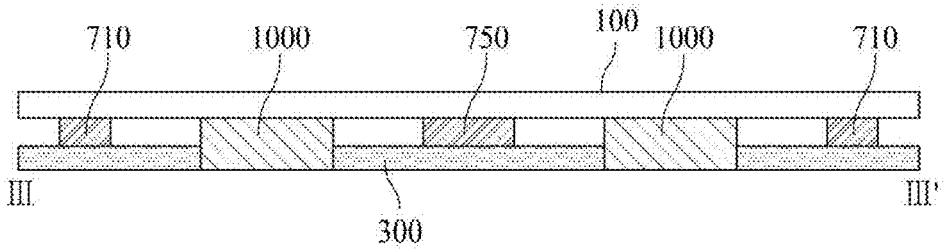
FIG. 9B is a cross-sectional view taken along of FIG. 9A.

FIGS. 9A and 9B are diagrams illustrating an example of the sound generating device 1200 and partition 700 according to the example embodiment of the present disclosure. FIG. 9B is a cross-sectional view taken along of FIG. 9A.

A fixing device 1000 for integrally fixing the two sound generating devices 1200 may be disposed in each of left and right areas of the display panel 100. The sound generating device is surrounded by partitions 750, 700, and 710. The partition 750 may be provided in a central area on a rear surface of the display panel 100. The partition 700 may be provided in each of lower and upper sides of the fixing device 1000 for fixing the sound generating devices 1200 disposed in the left and right areas of the display panel 100. The partition 710 may be provided in the different direction from that of the partition 700 disposed in each of the lower and upper sides, and is disposed at an end of left and right sides with respect to the rear surface of the display panel 100.

And, the partitions 700, 710, 750 for improving transmission efficiency of the sound vibration generated in the sound generating device 1200 to a user may have different compression force deflections (CFD) to each other. Herein, the compression force deflection (CFD) indicates the deformation of the partition 700 when a compression force is applied to a foam used for the partition 700 with respect to a physical characteristics measurement. The compression force deflection (CFD) may be measured by density as the main factor, and may be changed based on the density of the foam. A unit of the density is $g/cm^3$, and a unit of the compression force deflection is $kgf/cm^2$. The compression force deflection (CFD) may be expressed as a foaming rate, which may be a rate of gas contributing for forming the foam in a unit volume by adjusting a rate of material for forming the foam. This may be a utilization efficiency of gas generated by the foam. The compression force deflection (CFD), which may be measured by a foam tape using the foam, may be, for example, a thickness of 0.8 mm, a density of 0.18 $g/cm^3$, and CFD of 0.25 $kgf/cm^2$, that is, 25%.

The density may be contrary to the foaming rate, and the density may be contrary to the compression force deflection (CFD). That is, if the density is high, the compression force deflection is lowered and the foaming rate is also lowered.

Additionally, stiffness in the sound field will be described. Generally, when the deformation (displacement) 'x' occurs by an external force 'f' applied to an elastic body, the formulation of stiffness is '$f=Sx$', wherein 'f' is proportional to 'x'. Herein, 'S' indicates the stiffness or hardness. In case of the same external force, if the displacement is increased, the compression force deflection is increased, but on the contrary, the stiffness is decreased so that it is viewed as the opposite concept. However, the compression force deflection is a unit related to the foam, and the stiffness is a unit related to a vibrating body of the sound generating device, so the two may not be comparable. In this disclosure, for the sake of understanding, the compression force deflection corresponding to the unit related with the foam will be described.

As an example of applying the compression force deflection, in case of the partition 750 disposed in the central area, the partition 750 may be formed of the material having the compression force deflection of about 10%. Also, the partition 700 positioned in the upper and lower sides of the sound generating device 1200 disposed in each of the left and right areas of the rear surface of the display panel 100 may be formed of the material having the compression force deflection of about 30%. And, the partition 710 disposed at the left and right ends of the rear surface of the display panel 100 may be formed of the material having the compression force deflection of about 50%. For example, the area provided with the partition includes first, second and third areas, and the compression force deflection of the partition disposed in the first and third areas may be higher than the compression force deflection of the partition disposed in the second area. The partitions disposed in the first and third areas are parallel to the lower and upper sides with respect to the sound generating device, and include at least two of the first partition having the first compression force deflection and the second partition having the second compression force deflection, wherein the second partition may be provided in a different direction from that of the first partition. The first compression force deflection may be lower than the second compression force deflection. In this disclosure, while example values of compression force deflection have been discussed, embodiments are not limited thereto, and various values of the compression force deflection may be applied. Accordingly, the compression force deflection can be applied to a form gradually increasing from the central area to each of the left and right ends on the rear surface of the display panel 100. As the sound vibration generated in the sound generating device 1200 attached to the rear surface of the display panel 100 mutually interacts with the partitions having the different compression force deflections in the respective areas, the sound vibration is gradually increased from the central area to the left and right ends of the display panel 100, whereby it may be possible to improve a user's sense of immersion to a user positioned in the front of the display panel 100. The partition may be formed of ethylene propylene diene monomer (EPDM) or polyurethane, but is not limited thereto.

An apparatus for analyzing the sound of the display panel, which is generated by the sound generating device 1200, may include a sound card for receiving sound from a control PC, and transmitting sound to the control PC, an amplifier for amplifying the sound (signal) generated from the sound card, and transmitting the amplified sound to the sound generating device 1200, and a microphone for collecting the sound generated in the display panel through the sound generating device 1200. The sound collected in the microphone is provided to the control PC through the sound card, and then the control PC checks the provided sound, and analyzes the sound of the sound generating device 1200.

Figure 10:
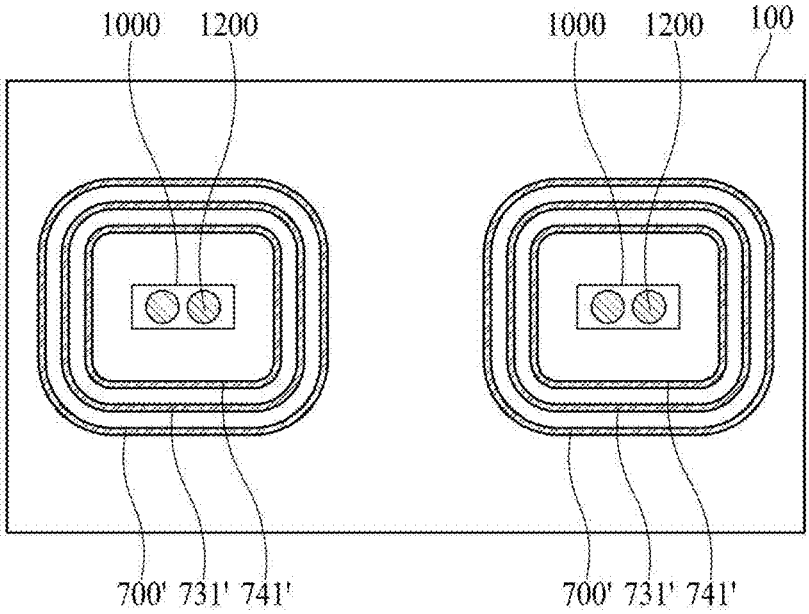
FIGS. 10 to 15 are diagrams for describing various structures of connecting the sound generating device and partition with a rear surface of a display panel according to an embodiment of the present disclosure.

FIG. 10 is a diagram illustrating an example of the sound generating device 1200 and partition 700' according to the example embodiment of the present disclosure. The partition 700' may be formed in a circle or quadrangular shape. This disclosure will be described with reference to the partition 700' formed in the quadrangular shape. Herein, the fixing device 1000 including the sound generating device 1200 may be disposed in the left and right areas on the rear surface of the display panel 100, and a first partition 700' may be disposed around the sound generating device 1200. The second and third partitions 731' and 741' may be disposed inside the first partition 700', wherein the first, second and third partitions 700', 731' and 741' may have the same shape, and the second and third partitions 731' and 741' may be relatively smaller than the first partition 700'.

As described for FIG. 9A, the first, second and third partitions 700', 731' and 741' may have different compression force deflections. For example, the compression force deflection of the first partition 700' is about 10%, the compression force deflection of the second partition 731' is about 30%, and the compression force deflection of the third partition 741' is about 50%. In this case, as the sound vibration generated in the sound generating device 1200 is gradually decreased to the first partition 700' through the third partition 741' and the second partition 731', the relatively-high sound vibration is generated in the sound generating device 1200 so that it may be possible to improve a user's immersion to a user positioned in the front of the display panel 100.

Figure 11:
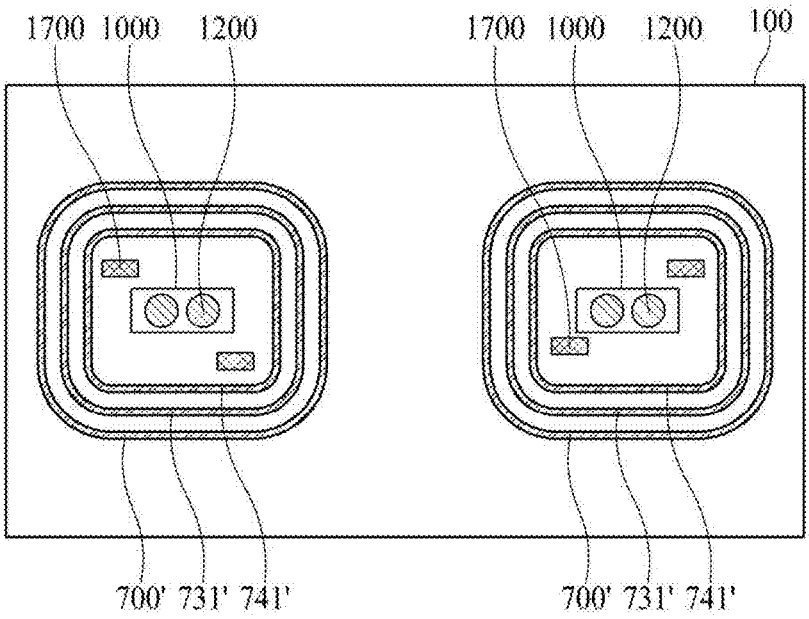

FIG. 11 is diagram an example of the sound generating device 1200, partition 700' and node 1700 according to the example embodiment of the present disclosure. As described for FIG. 10, if providing the plurality of partitions, the sound vibration generated in the sound generating device 1200 advances toward the partition 700' and is then reflected on the partition 700'. In this case, when the reflected sound vibration and the additionally-generated sound vibration meet in a specific area, they are in mutual opposite polarities, whereby the sound vibration may be offset. In order to control the offset vibration, a partition piece whose material is the same as that of the partition 700' disposed in the corresponding position is attached to prevent the mutual offset between the sound vibrations. This partition piece may be referred to as a division resonance point 1700. As shown in FIG. 10, the partition piece may be disposed at a predetermined distance or in a predetermined direction with respect to the sound generating device. The optimal position of the division resonance point 1700 may be set by the use of a laser doppler device. Herein, after a sound vibration surface of the display panel 100 is irradiated with a laser provided from the laser doppler device, the laser doppler device may be capable of checking a vibration spread shape by the use of laser scattering shape. Then, the amplification of the vibration and the offset point may be checked, and the division resonance point may be positioned at the offset vibration point.

Figure 12:
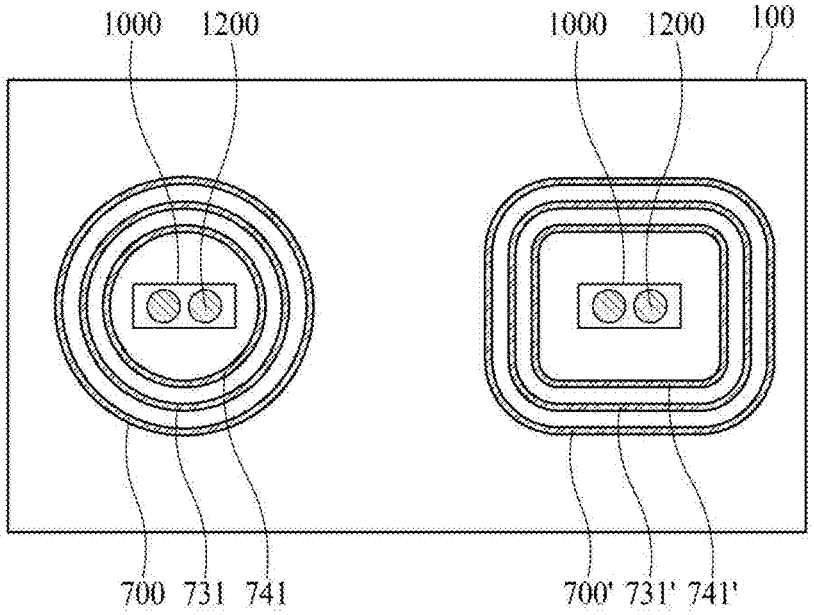

FIG. 12 is diagram an example of the sound generating device 1200 and partition 700 according to the example embodiment of the present disclosure. A fourth partition 700 is disposed around the sound generating device 1200 disposed in the left area of the rear surface of the display panel 100, and a first partition 700' is disposed around the sound generating device 1200 disposed in the right area of the rear surface of the display panel 100. According to one example, the fourth partition 700 may have a circle shape surrounding the sound generating device 1200, and the first partition 700' may have a polygonal shape surrounding the sound generating device 1200. However, embodiments are not limited thereto, and the shapes of the partitions disposed in the left and right areas may be opposite to those of the above. For example, the first partition 700' may be disposed in the left area of the rear surface of the display panel 100, and the fourth partition 700 may be disposed in the right area of the rear surface of the display panel 100.

In the case of the sound generating device disposed in the left area of the rear surface of the display panel 100, the sound generating device may be disposed in the center of the fourth partition 700. The sound generating device of the left area may be disposed more toward one side of the fourth partition 700 in accordance with the shape of the sound vibration. The fourth partition 700 may be formed in an oval shape by changing a curvature of a circle shape. Also, in the case of the sound generating device disposed in the right area of the rear surface of the display panel 100, the sound generating device may be disposed in the center of the first partition 700'. According to the shape of the sound vibration, the sound generating device may be disposed more toward one side of the first partition 700', or the first partition 700' may be formed in a polygonal shape whose internal angles are an acute angle and an obtuse angle instead of a right angle.

The fourth partition 700 is disposed at the same radius from the sound generating device 1200. As the sound vibration is transmitted to and reflected on the partition disposed at the same distance from the sound generating device 1200, it may be possible to generate the uniform sound wave without an inflection point for the sound analysis. Thus, the first partition 700' may provide advantages to generation of the sound vibration. The first partition 700' may be obtained by combining the linear partitions and therefore may have advantages of low material cost, easy arrangement, and change of arrangement. If the sound generating device 1200 is formed in a polygonal shape in accordance with the first partition 700', it may be possible to maintain a constant distance between the sound generating device 1200 and each surface of the partition.

Inside the first partition 700', there are second and third partitions 731' and 741', wherein the first, second and third partitions 700', 731' and 741' may have the same shape, and the second and third partitions 731' and 741' may be relatively smaller than the first partition 700'. Then, a fifth partition 731 and a sixth partition 741 may be additionally provided inside the fourth partition 700, wherein the fourth, fifth and sixth partitions 700, 731 and 741 may have the same shape, and the fifth and sixth partitions 731' and 741' may be relatively smaller than the fourth partition 700. In another way, the fourth, fifth and sixth partitions 700, 731 and 741 may be positioned on the respective circumferences with the different radii around the fixing device 1000. The compression force deflection of the fifth partition 731 may be different from the compression force deflection of the sixth partition 741, and the compression force deflection of the second partition 731' may be different from the compression force deflection of the third partition 741'. For example, the compression force deflection of each of the fourth partition 700 and the first partition 700' may be about 10%, the compression force deflection of each of the fifth partition 731 and the second partition 731' may be about 30%, and the compression force deflection of each of the sixth partition 741 and the third partition 741' may be about 50%. With this configuration, as described in FIG. 10, according as the sound vibration generated in the sound generating device 1200 is gradually decreased toward the fourth partition 700 through the sixth partition 741 and the fifth partition 731, the sound generating device 1200 has the relatively-high sound vibration so that it is possible to improve a user's immersion to a user positioned in the front of the display panel 100.

Figure 13:
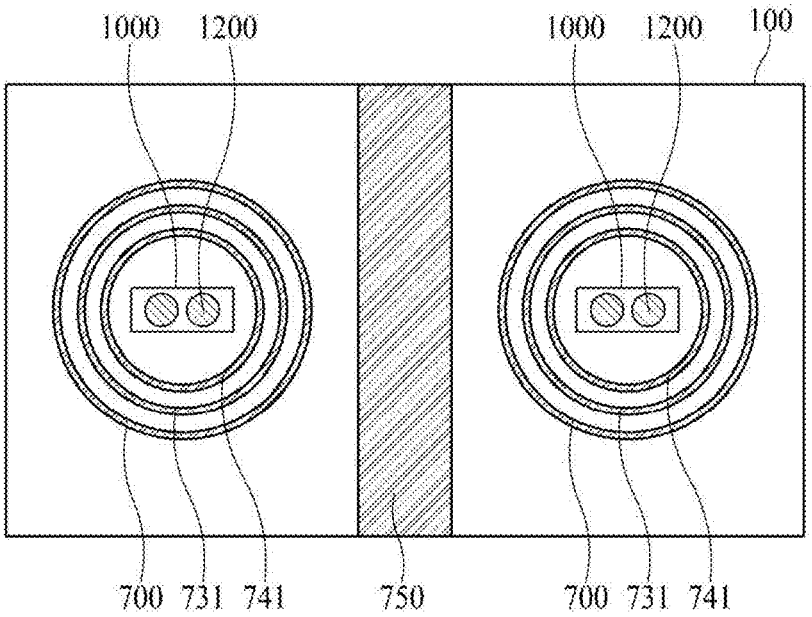

FIG. 13 is diagram an example of the sound generating device 1200 and partition 700 and 750 according to the example embodiment of the present disclosure. As described in FIG. 10, the fixing device 1000 including the sound generating device 1200 may be disposed in the left and right areas on the rear surface of the display panel 100, and several circle-shaped partitions 700, 731 and 741 may be positioned on the respective circumferences with the different radii around the fixing device 1000. As described in FIG. 9A, a partition 750 may be disposed in the central area with respect to the rear surface of the display panel 100. Thus, in comparison to sound vibration efficiency of the sound generating device disposed in the central area of the display panel 100, it may be possible to realize relatively-improved sound vibration efficiency of the sound generating device 1200 disposed in the left and right areas of the display panel 100. For example, the compression force deflection of the partition 750 disposed in the central area of the display panel 100 is about 10%, the compression force deflection of the outermost partition 700 among the partitions surrounding the sound generating device 1200 is about 10%, the compression force deflection of the inner partition 731 is about 30%, and the compression force deflection of the innermost partition 741 is about 50%. In this case, the central area of the display panel 100 may be supported by the partition 750 of the central area. If the sound vibration is generated by the sound generating device 1200 disposed in the left and right areas of the display panel 100, the left and right areas of the display panel 100 are vibrated at the front and back directions in comparison to the central area of the display panel 100, whereby the sound of the display panel 100 is collected in the central area where a user is positioned at the front of the display panel 100. Also, it may be possible to realize clear left and right areas of the sound vibration generated in the sound generating device 1200 of the left and right areas, to thereby improve a stereo sound quality. The compression force deflections are not limited thereto.

Figure 14:
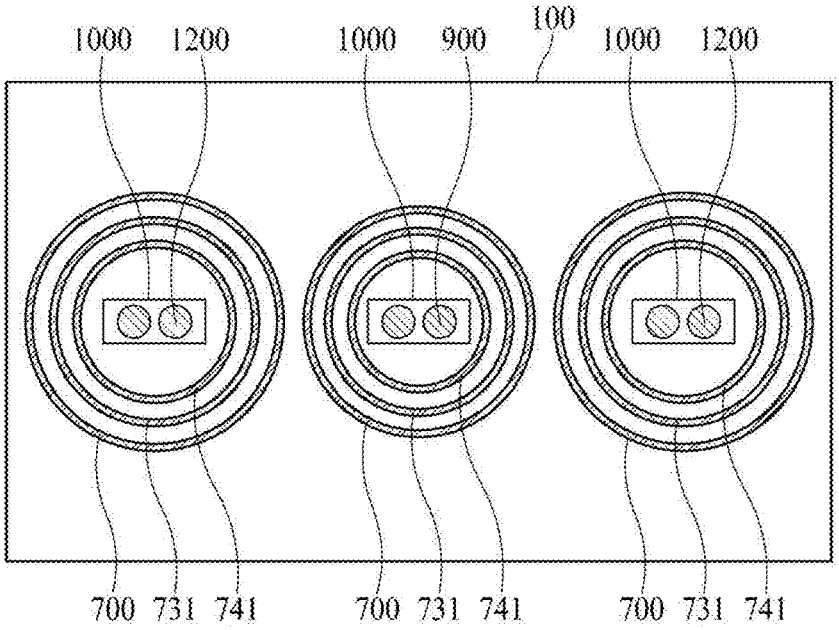

FIG. 14 illustrates an example of the sound generating device 1200 and partition 700, 731 and 741 according to the example embodiment of the present disclosure. As described for FIG. 13, the sound generating device 1200 may be disposed in each of the left and right areas with respect to the rear surface of the display panel 100, and the circle-shaped partitions 700, 731 and 741 may be disposed to surround the sound generating device 1200. In addition, a low sound generating device 900 and circle-shaped partitions 700, 731 and 741 surrounding the low sound generating device 900 may be disposed in the central area of the display panel 10 except the sound generating device 1200 disposed in the left and right areas. If providing the low sound generating device 900 and the sound generating devices 1200 and 1200' with the high sound pressure disposed in the left and right areas, the low sound generating device 900 may be used as a low sound speaker (e.g., woofer speaker) so that it may be possible to realize the sound output characteristics of 2.1 channel type. If the low sound generating device 900 is used as a central speaker, it may be possible to realize the sound output characteristics of 3.1 channel type, and thus, the middle-high sound band and the low-pitched sound band may be realized by generating the sound vibration in the wide sound band.

In this disclosure, the low-pitched sound band may be the sound of 200 Hz or less than 200 Hz, the middle-pitched sound band may be the sound between 200 Hz and 3 kHz, and the high-range sound may be the sound of 3 kHz or more than 3 kHz, but embodiments are not limited thereto.

In this disclosure, as an example, any one of first and second methods may be selectively applied. In case of the first method, a low sound threshold frequency of the low sound generating device 900 is lower than a low sound threshold frequency of the sound generating device 1200 disposed in each of the left and right areas of the display panel 100. In case of the second method, a size of the low sound generating device disposed in the central area is larger than a size of each of the sound generating devices 1200 disposed in the left and right areas of the display panel 100. Herein, the low sound threshold frequency is the lowest value of a regeneration frequency band for each sound generating device, that is, the low sound threshold frequency indicates the frequency of the lowest sound wave generated by each sound generating device, which may be expressed as the lowest resonance vibration number.

As the low-pitched sound band is relatively larger than the middle-high-pitched sound band, it may be possible to improve the sound output characteristics of the low-pitched sound band. In this embodiment of the present disclosure, it may be possible to select any one of the first and second methods without restrictions.

Figure 15:
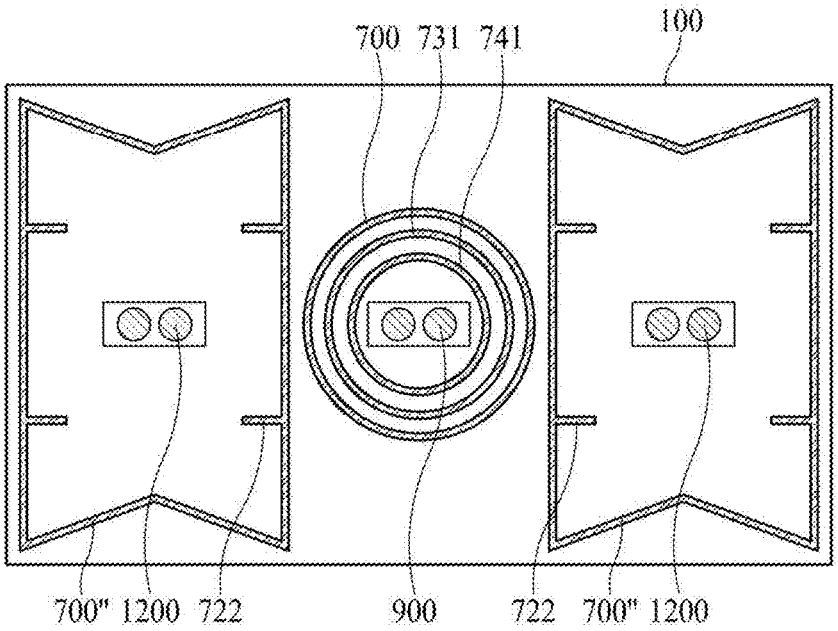

FIG. 15 illustrates an example of the sound generating device 1200 and partition 700, 731 and 741 according to the example embodiment of the present disclosure. A low sound generating device 900 is disposed in the central area of the display panel 100, and circle-shaped partitions 700, 731 and 741 are disposed to surround the low sound generating device 900. Also, a sound generating device 1200 is disposed in each of the left and right areas of the display panel 100, and a partition 700" which is formed in a polygonal shape of a bow-tie shape is disposed to surround each of the sound generating devices 1200. For example, if the rear surface of the display panel 100 is divided into first, second and third areas, the low sound generating device 900 and the circle partition 700 are disposed in the second area, and the sound generating device 1200 and the polygonal partition 700" are disposed in each of the first and third areas. The polygonal partition 700" has a bent portion which is bent toward the sound generating device 1200, whereby the polygonal partition 700" is formed in a bow-tie shape.

Also, a protrusion portion 722 may be additionally provided inside the polygonal partition 700" having the bow-tie shape. The protrusion portion 722 may be capable of trapping the reflected wave, and decreasing the reduction of sound pressure by the standing wave. Thus, it may be possible to optimize the sound vibration of the sound generating device 1200 for generating the middle-high sound.

In the display apparatus according to example embodiments of the present disclosure, a pair of sound generating devices may be disposed in each of the left and right areas of the display panel so that it may be possible to generate the stereo sound output.

Furthermore, in the display apparatus according to example embodiments of the present disclosure, a pair of sound generating devices may be disposed in each of the left, right and central areas of the display panel so that it may be possible to provide the display apparatus capable of generating the stereo sound output.

Furthermore, in the display apparatus according to example embodiments of the present disclosure, as a plurality of partitions may be disposed in the periphery of the sound generating devices, it may be possible to provide the display apparatus capable of realizing the improved sound vibration efficiency of the sound generating device.

Furthermore, in the display apparatus according to example embodiments of the present disclosure, according as the partition disposed in the sound generating device may be formed in the various shapes, for example, circle shape, quadrangle shape, bow-tie shape, and etc., it may be possible to provide the display apparatus capable of improving the sound quality.

The display apparatus according to the example embodiment of the present disclosure may include a liquid crystal display (LCD) device, a field emission display (FED) device, an organic light emitting display (OLED) device, a quantum dot display apparatus, etc.

The display apparatus according to the embodiment of the present disclosure may include equipment displays including the complete product or final product of an LCM or OLED module, for example, a notebook computer, television, computer monitor, automotive display, or vehicle display, and set electronic devices or set device (set apparatus) such as mobile electronic devices including smart phone or electronic pad.

According to the example embodiment of the present disclosure, the display apparatus may include the display panel configured to display an image, the supporting member disposed on the rear surface of the display panel, at least one sound generating device disposed between the supporting member and the display panel, at least one partition provided at a predetermined interval from at least one sound generating device, wherein the partitions have the different compression force deflections, and the adhesion member provided in the periphery of the display panel.

According to the embodiment of the present disclosure, the area with the partition includes first, second and third areas, wherein the compression force deflection of the partition disposed in each of the first and third areas is higher than the compression force deflection of the partition disposed in the second area.

According to the embodiment of the present disclosure, the partitions disposed in the first and third areas include at least two of first partition which is parallel to lower and upper sides with respect to the sound generating device and has the first compression force deflection, and the second partition which is formed in the different direction from that of the first partition and has a second compression force deflection, wherein the first compression force deflection is lower than the second compression force deflection.

According to the embodiment of the present disclosure, the compression force deflection of the partition is gradually increased from the central area of the display panel to the left and right ends of the display panel.

According to the embodiment of the present disclosure, the partition includes at least one of first partition and at least one of second partition around the sound generating device.

According to the embodiment of the present disclosure, the first partition and the second partition have the same shape.

According to the embodiment of the present disclosure, the second partition is disposed inside the first partition, and the compression force deflection of the first partition is smaller than the compression force deflection of the second partition.

According to the embodiment of the present disclosure, the first partition and the second partition are disposed on the respective circumstances with the different radii around the sound generating device.

According to the embodiment of the present disclosure, the display apparatus further includes at least one division resonance point disposed inside at least one partition.

According to the embodiment of the present disclosure, at least one partition is formed in the polygonal shape.

According to the embodiment of the present disclosure, the display apparatus may include the display panel configured to display an image, the supporting member disposed on the rear surface of the display panel, at least one sound generating device disposed between the supporting member and the display panel, at least one partition provided at a predetermined interval from at least one sound generating device, wherein the partitions have the different densities, and the adhesion member provided in the periphery of the display panel.

According to the embodiment of the present disclosure, the area with the partition includes first, second and third areas, and at least one sound generating device is disposed in each of the first and third areas, wherein the density of the partition disposed in each of the first and third areas is lower than the density of the partition disposed in the second area.

According to the embodiment of the present disclosure, the partitions disposed in the first and third areas include at least two of first partition which is parallel to lower and upper sides with respect to the sound generating device and has the first density, and the second partition which is formed in the different direction from that of the first partition and has the second density, wherein the first density is larger than the second density.

According to the embodiment of the present disclosure, the density of the partition is gradually decreased from the central area of the display panel to the left and right ends of the display panel.

According to the embodiment of the present disclosure, the display apparatus further includes a heat-dissipation member disposed between the display panel and the sound generating device.

According to the embodiment of the present disclosure, the heat-dissipation member is formed of the metal material.

According to the embodiment of the present disclosure, the sound generating device includes at least one of low sound generating device and at least one of middle-high sound generating device.

According to the embodiment of the present disclosure, the partition surrounding at least one of middle-high sound generating device is formed in the bow-tie shape.

According to the embodiment of the present disclosure, the bow-tie partition includes at least two of protrusion portion.

According to the embodiment of the present disclosure, the display apparatus further includes at least one division resonance point prepared inside at least one partition, wherein at least one partition is formed in the polygonal shape.

According to an example embodiment of the present disclosure, a display apparatus may include a display panel configured to display an image by emitting light, a supporting member disposed on a rear surface of the display panel, a sound generating device disposed between the supporting member and the display panel, and a plurality of partitions at a predetermined interval from the sound generating device, wherein the partitions have different compression force deflections.

Furthermore, an area with the partitions may include first, second, and third areas, and at least one sound generating device may be disposed in each of the first and third areas, and the compression force deflection of the partition disposed in each of the first and third areas may be higher than the compression force deflection of the partition disposed in the second area, wherein the second area corresponds to a central area of the display panel, and the first and third areas correspond to left and right areas of the display panel.

Also, the partitions disposed in the first and third areas may include at least two of a first partition at lower and upper sides of the sound generating device and having a first compression force deflection, the two of the first partition being parallel to each other, and a second partition which is formed in a different direction from that of the first partition and has a second compression force deflection, and the first compression force deflection is lower than the second compression force deflection.

Additionally, the compression force deflection of the partitions may be less at a central area of the display panel than at left and right ends of the display panel.

Furthermore, the partitions may include at least one of a first partition and at least one of a second partition around the sound generating device.

Also, the first partition and the second partition may have the same shape.

Additionally, the second partition may be disposed inside the first partition, and the compression force deflection of the first partition may be smaller than the compression force deflection of the second partition.

Furthermore, the first partition and the second partition may be disposed on respective circumferences with different radii around the sound generating device.

Also, the display apparatus may further include at least one division resonance point disposed inside at least one of the partitions, wherein at least one of the partitions is formed in a polygonal shape.

Additionally, the sound generating device may include at least one of a low sound generating device and at least one of a middle-high sound generating device.

Furthermore, the partition surrounding at least one of the middle-high sound generating device may be formed in a bow-tie shape.

Also, the partition formed in a bow-tie shape may include at least two protrusion portions.

According to an example embodiment of the present disclosure, a display apparatus may include a display panel configured to display an image by emitting light, a supporting member disposed on a rear surface of the display panel, a sound generating device disposed between the supporting member and the display panel, and a plurality of partitions provided at a predetermined interval from the sound generating device, wherein the partitions have different densities.

Furthermore, an area with the partitions may include first, second, and third areas, and at least one sound generating device may be disposed in each of the first and third areas, and the density of the partition disposed in each of the first and third areas may be lower than the density of the partition disposed in the second area, wherein the second area corresponds to a central area of the display panel, and the first and third areas correspond to left and right areas of the display panel.

Also, the partitions disposed in the first and third areas may include at least two of a first partition at lower and upper sides of the sound generating device and having a first density, the two of the first partition being parallel to each other, and a second partition which is formed in a different direction from that of the first partition and has a second density, and the first density may be larger than the second density.

Additionally, the density of the partitions may be greater at a central area of the display panel than at left and right ends of the display panel.

Furthermore, the sound generating device may include at least one of a low sound generating device and at least one of a middle-high sound generating device.

Also, the partition surrounding at least one of the middle-high sound generating device may be formed in a bow-tie shape.

Additionally, the partition formed in a bow-tie shape may include at least two protrusion portions.

Furthermore, the display apparatus may further include at least one division resonance point inside at least one partition, wherein at least one partition is formed in a polygonal shape.

According to example embodiments of the present disclosure, the display apparatus includes the sound generating device capable of generating sound by vibrating the display panel, whereby the sound is output to the front direction of the display panel, to thereby improve a user's immersion.

Also, the display apparatus according to example embodiments of the present disclosure includes the sound generating device capable of generating sound by vibrating the display panel. Thus, there is no need for the speaker so that it enables to improve the degree of freedom on design of the set apparatus and arrangement of the speaker.

In the display apparatus according to example embodiments of the present disclosure, the supporting member and the sound generating device are fixed by the use of screw and nut in the supporting member, to thereby reduce the thickness of the display panel.

According as the display apparatus according to example embodiments of the present disclosure includes the fixing device for fixing a pair of sound generating devices, it is possible to generate the uniform sound pressure in the entire frequency range.

Also, the display apparatus according to example embodiments of the present disclosure includes the fixing device for fixing a pair of sound generating devices, and the plurality of rib portions disposed in the periphery of the sound generating device so that it is possible to maintain hardness of the sound generating device, and to minimize the change of sound output characteristics even in a case of long-time use.

In the display apparatus according to example embodiments of the present disclosure, a pair of sound generating devices is disposed in each of the left and right areas of the display panel so that it is possible to realize the stereo sound quality.

According as the display apparatus according to example embodiments of the present disclosure includes the partitions disposed in the circumference of the sound generating device, it is possible to improve the sound vibration efficiency of the sound generating device.

In the display apparatus according to example embodiments of the present disclosure, the partitions disposed to surround the sound generating device have the different compression force deflections so that it is possible to focus the sound vibration generated in the sound generating device at a predetermined area, or to divide the entire area of the display panel into several areas and to vibrate the divided areas, to thereby improving the sound quality.

Also, the partition disposed in the sound generating device may be formed in the circle shape, quadrangle shape, bow-tie shape, and etc., and it is possible to realize the uniform sound wave, and to improve the sound quality.

It will be apparent to those skilled in the art that various modifications and variations can be made in the present disclosure without departing from the spirit or scope of the disclosures. Thus, it is intended that the present disclosure covers the modifications and variations of this disclosure provided they come within the scope of the appended claims and their equivalents.

What is claimed is:

1. A display apparatus, comprising:

a display panel configured to display an image by emitting light;

a supporting member on a rear surface of the display panel;

a first sound generating devices on the rear surface of the display panel and configured to vibrate the display panel to generate sound; and a plurality of first partitions surrounding the first sound generating devices, each of the plurality of the first partitions being spaced apart from each other with an interval from the first sound generating device.

2. The display apparatus according to claim 1, further comprising:

a second sound generating device on the rear surface of the display panel;

a plurality of second partitions surrounding the second sound generating devices, each of the plurality of the second partitions being spaced apart from the second sound generating device having an interval.

3. The display apparatus according to claim 2, wherein the plurality of first partitions have circular shapes or polygonal shapes, and the plurality of second partitions have same shapes as the plurality of first partitions.

4. The display apparatus according to claim 2, further comprising:

a third partition at a third area of the display panel, wherein the first sound generating device and the plurality of first partitions are disposed at a first area, and the second sound generating device and the plurality of second partitions are disposed at a second area.

5. The display apparatus according to claim 2, further comprising:

a third sound generating devices on the rear surface of the display panel; and a plurality of third partitions surrounding the third sound generating devices, each of the plurality of the third partitions being spaced apart from the third sound generating device having an interval, wherein the third sound generating device and the plurality of third partitions are disposed at a third area of the display panel, and the first sound generating device and the plurality of first partitions are disposed at a first area, and the second sound generating device and the plurality of second partitions are disposed at a second area.

6. The display apparatus according to claim 5, wherein the plurality of third partitions have circular shapes or polygonal shapes, and the plurality of third partitions have same shapes as the plurality of first partitions.

7. The display apparatus according to claim 2, wherein the plurality of first partitions have circular shapes or polygonal shapes, and the plurality of second partitions have different shapes from the plurality of first partitions.

8. The display apparatus according to claim 2, further comprising:

at least one or more of a resonance point inside at least one or more of the plurality of first partitions the plurality of second partitions and being spaced apart from the first sound generating device or the second sound generating device.

9. The display apparatus according to claim 8, wherein the at least one or more of the resonance point is disposed at an offset vibration point of the first sound generating device or the second sound generating device.

10. The display apparatus according to claim 4, wherein a compression force deflection of the plurality of third partitions is less than those of the plurality of first partitions and the plurality of second partitions.

11. The display apparatus according to claim 4, wherein a first density of the plurality of first partitions and a second density of the plurality of second partitions are less than a third density of the plurality of third partitions.

12. The display apparatus according to claim 1, wherein the first sound generating device includes:

a plate;

a magnet on the plate;

a center pole on the plate;

a bobbin around the center pole;

a coil wound on an outer surface of the bobbin;

a frame along a periphery of the plate; and a damper between the frame and an upper side of the bobbin.

13. The display apparatus according to claim 12, further including:

a heat-dissipation member between the sound generating device and the display panel.

14. The display apparatus according to claim 13, wherein the heat-dissipation member is disposed on an upper surface of the bobbin.

15. A display apparatus, comprising:

a display panel configured to display an image by emitting light;

a supporting member on a rear surface of the display panel;

at least one sound generating device on the rear surface of the display panel and configured to vibrate the display panel to generate sound; and a plurality of partitions having an interval from the at least one sound generating device, the plurality of partitions having different radii from each other from the at least one sound generating device.

16. The display apparatus according to claim 15, wherein the display panel includes a first area, a second area, and a third area and the at least one sound generating device is disposed in each of the first area to the third area.

17. The display apparatus according to claim 16, further comprising a partition surrounding the least one sound generating device in the first area and the third area, the partition having a bow-tie shape.

18. The display apparatus according to claim 16, further comprising a partition surrounding the a least one sound generating device in the first area and the third area, the partition having a bow-tie shape and one or more of a protrusion portion toward the at least one sound generating device.

19. The display apparatus according to claim 16, further comprising the at least one sound generating device in the second area and the plurality of partitions surrounding the at least one sound generating device in the second area.

20. The display apparatus according to claim 19, wherein the at least one sound generating device in the second area is a low sound generating device and the at least one sound generating device in the first area and the third area is a middle-high generating device.

21. The display apparatus according to claim 15, wherein the display panel includes a first area, a second area, and a third area and the at least one sound generating device is disposed in each of the first area, the second area, and the third area, and the plurality of partitions surrounding the at least one sound generating device in the first area, the second area, and the third area.

22. The display apparatus according to claim 21, wherein the plurality of partitions includes a first partition, a second partition, and a third partition, and the first partition, the second partition, and the third partition have different densities.

* * * * *